US010350881B2

(12) United States Patent
Shinohara

(10) Patent No.: US 10,350,881 B2
(45) Date of Patent: Jul. 16, 2019

(54) PRINTER, METHOD OF PRINTING, AND COMPUTER-READABLE STORAGE MEDIUM

(71) Applicant: CASIO COMPUTER CO., LTD., Tokyo (JP)

(72) Inventor: Sumito Shinohara, Tokyo (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/463,193

(22) Filed: Mar. 20, 2017

(65) Prior Publication Data

US 2017/0274644 A1 Sep. 28, 2017

(30) Foreign Application Priority Data

Mar. 23, 2016 (JP) ..... 2016-058131

(51) Int. Cl.
*B41J 2/045* (2006.01)

(52) U.S. Cl.
CPC ..... *B41J 2/04508* (2013.01); *B41J 2/04586* (2013.01)

(58) Field of Classification Search
CPC . B41J 11/0095; B41J 29/38; B41J 3/36; B41J 2/04586; B41J 2/04508; B41J 29/393
USPC ..... 347/5, 9, 14, 16, 19, 109
See application file for complete search history.

(56) References Cited

U.S. PATENT DOCUMENTS

2013/0257973 A1* 10/2013 Tamura ..... B41J 11/42 347/19

FOREIGN PATENT DOCUMENTS

| | | | |
|---|---|---|---|
| JP | S62-119066 | A | 5/1987 |
| JP | S63-198265 | U | 12/1988 |
| JP | H9-309229 | A | 12/1997 |
| JP | H10-16313 | A | 1/1998 |
| JP | 2001-315385 | A | 11/2001 |
| JP | 2015-182330 | A | 10/2015 |
| JP | 2016-010969 | A | 1/2016 |

OTHER PUBLICATIONS

Chinese Office Action dated Jul. 16, 2018, in a counterpart Chinese patent application 201710133119.X. (A machine translation (not reviewed for accuracy) attached.).

* cited by examiner

*Primary Examiner* — Jannelle M Lebron
(74) *Attorney, Agent, or Firm* — Chen Yoshimura LLP

(57) ABSTRACT

A printer prints on a printing medium as the printer is moved. The printer includes a printing unit, a detector, and a controller. The printing unit prints an image on the printing medium. The detector detects a region on the printing medium that is not suitable to be printed on by the printing unit. The controller makes the printing unit stop printing when the detector detects the region on the printing medium that is not suitable to be printed on while the printing unit is printing.

12 Claims, 10 Drawing Sheets

PRINTER, METHOD OF PRINTING, AND COMPUTER-READABLE STORAGE MEDIUM

BACKGROUND OF THE INVENTION

1. Field of the Invention

The present invention relates to a printer, a method of printing, and a computer-readable storage medium.

Japanese Patent Application Laid-Open Publication No. H10-16313 discloses a printer that detects when a timing roller leaves the edge of a recording medium based on speed changes in the movement speed of a main case and stops printing accordingly.

The printer disclosed in Japanese Patent Application Laid-Open Publication No. H10-16313 calculates the movement speed on the basis of rotations of the timing roller when the main case is moved in the printing direction while the timing roller is contacting the recording paper and thus obtains speed change data based on the movement speed. If the change in speed is greater than or equal to a prescribed value, the printing operation is stopped.

In the printer disclosed in Japanese Patent Application Laid-Open Publication No. H10-16313, when the timing roller suddenly leaves the recording paper, the printing operation is stopped based on the resulting speed change. However, this printer does not detect when the region on the surface of the recording medium that is about to be printed on is a region that is not suitable for printing and thus does not stop the printing operation in this case. Therefore, even when attempting to prevent printing that is not expected by the user in regions outside of the printing region of the printing medium, the printer can only handle a limited number of situations.

The present invention was made in view of the above-mentioned problems and aims to provide a printer, a method of printing, and a computer-readable storage medium that make it possible to not only prevent printing when a timing roller of the device suddenly leaves the printing medium but to also prevent printing that is not expected by the user in regions outside of the printing region of the printing medium. Accordingly, the present invention is directed to a scheme that substantially obviates one or more of the problems due to limitations and disadvantages of the related art.

SUMMARY OF THE INVENTION

Additional or separate features and advantages of the invention will be set forth in the descriptions that follow and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, in one aspect, the present disclosure provides a printer for printing on a printing medium as the printer moves, including: a printing head printing an image on the printing medium; a detector arranged further forward in a movement direction of the printer than the printing head and detecting a boundary of the printing medium or a location on the printing medium not suitable to be printed on by the printing head; and a controller causing the printing head to stop printing before the printing head reaches the boundary of the printing medium or the location on the printing medium not suitable to be printed on, when the detector detects the boundary of the printing medium or the location on the printing medium not suitable to be printed on while the printing head is printing.

In another aspect, the present disclosure provides a method of printing on a printing medium by moving a printer over the printing medium, including: printing, using a printing head of the printer, an image on the printing medium; detecting, using a detector in the printer that is arranged further forward in a movement direction of the printer than the printing head, a boundary of the printing medium or a location on the printing medium not suitable to be printed on by the printing head; and causing the printing head to stop printing before the printing head reaches the boundary of the printing medium or the location on the printing medium not suitable to be printed on, when the detector detects the boundary of the printing medium or the location on the printing medium not suitable to be printed on while the printing head is printing.

In another aspect, the present disclosure provides a non-transitory storage medium that stores instructions executable by a processor in a printer for printing on a printing medium as the printer moves, the instructions causing the processor to perform the following: printing, using a printing head of the printer, an image on the printing medium; detecting, using a detector of the printer arranged further forward in a movement direction of the printer than the printing head, a boundary of the printing medium or a location on the printing medium not suitable to be printed on by the printing head; and causing the printing head to stop printing before the printing head reaches the boundary of the printing medium or the location on the printing medium not suitable to be printed on, when the detector detects the location on the printing medium not suitable to be printed on while the printing head is printing.

The present invention makes it possible to not only prevent printing when a timing roller of the device suddenly leaves the printing medium but to also prevent printing that is not expected by the user in regions outside of the printing region of the printing medium.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF EMBODIMENTS

Embodiment 1

Figure 1:
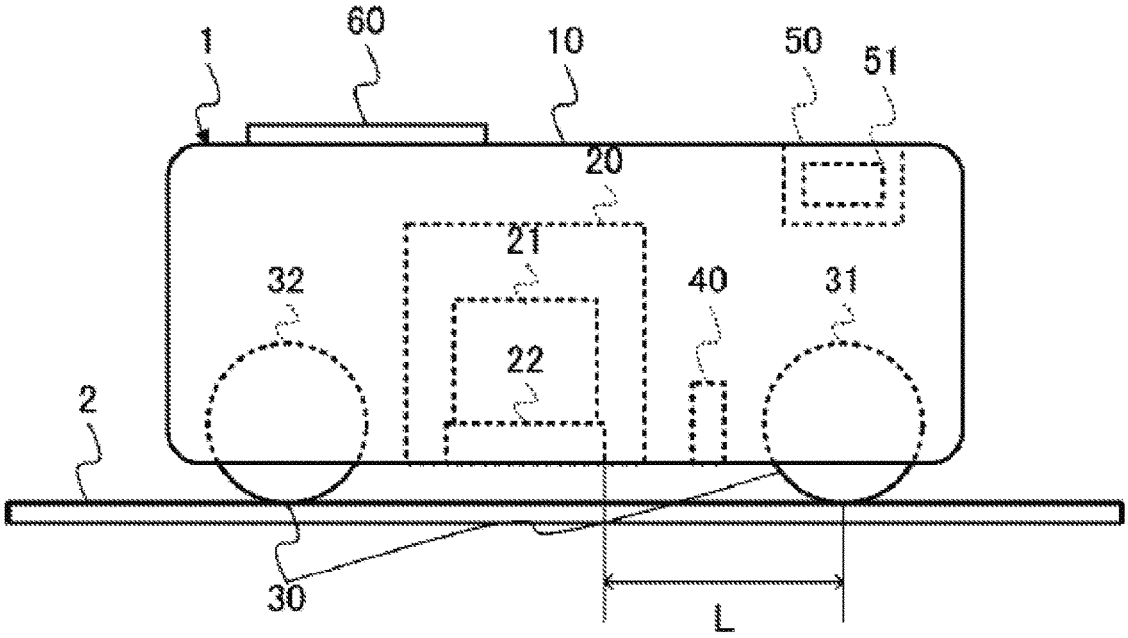
FIG. 1 is a side view of a printer according to Embodiment 1.

Next, a printer 1 according to Embodiment 1 will be described with reference to figures. Note that the same reference characters are used for components that are the same or equivalent in the figures.

Figure 2:
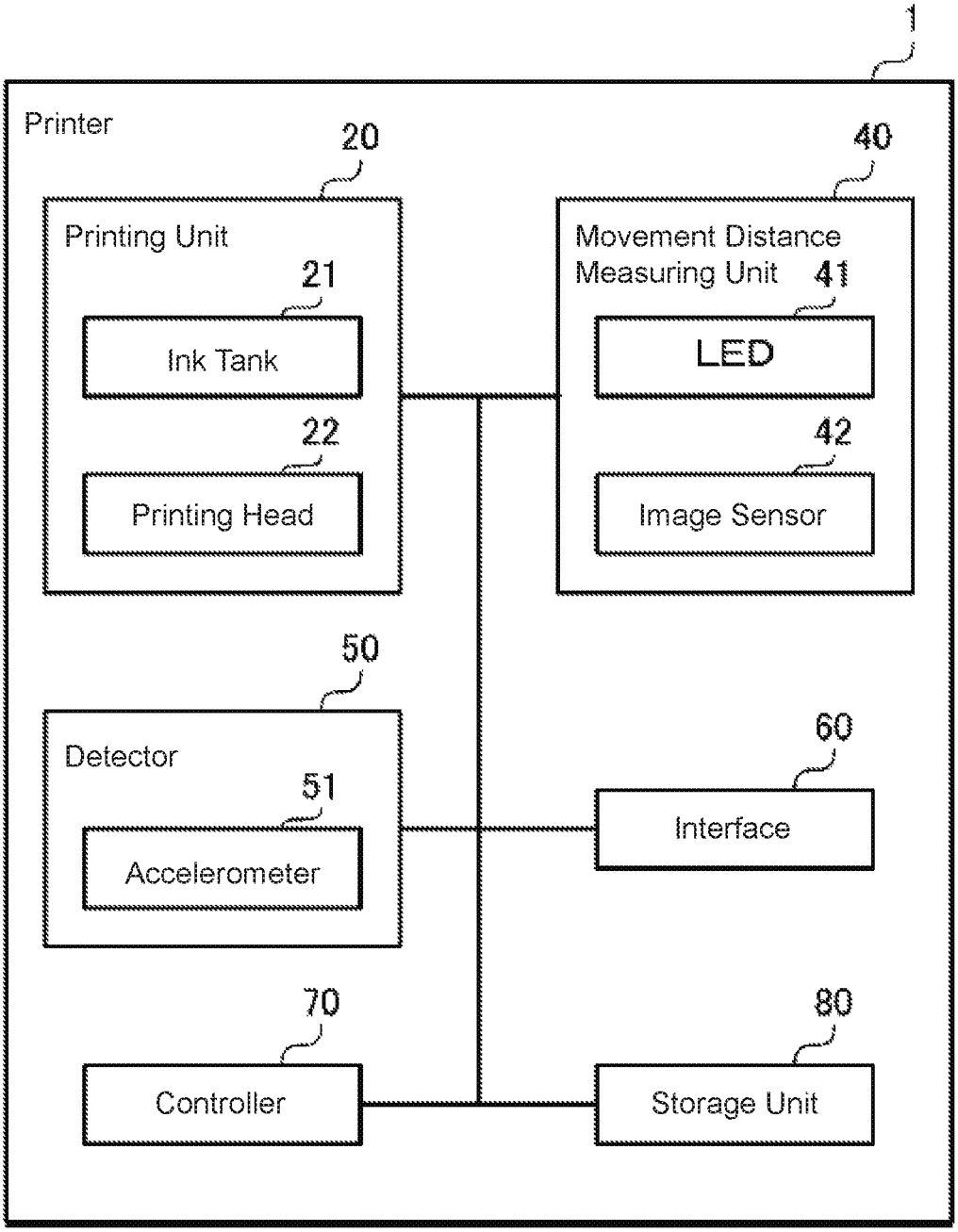
FIG. 2 is a block diagram illustrating a configuration of the printer according to Embodiment 1.

FIG. 1 is a side view of the printer 1 according to Embodiment 1, and FIG. 2 is a block diagram illustrating a configuration of the printer 1 according to Embodiment 1. The printer 1 is a manual scanning printer that a user can move in a sliding manner over a printing medium 2 to print images onto that printing medium. This type of manual scanning printer is also known as a handheld printer or a direct printer.

Note that in the present specification, "down" refers to the direction in which the printing medium 2 is present as viewed from the printer 1, and "forward" refers to the direction in which the user moves the printer 1 when printing.

The printing medium 2 may be printing paper, printing labels, or cardboard, for example, but is not limited to these examples. The printing medium 2 is also known as a recording medium or a printing object. Here, the printing medium 2 is made of paper and a resin, but the printing medium 2 may be any object in which a material that can accept ink is formed so as to provide a surface that can accept ink.

The images to be printed may be characters, symbols, graphics, patterns, pictures, or photographs, for example, but are not limited to these examples. The images to be printed are also known as print images or print patterns.

As illustrated in FIGS. 1 and 2, the printer 1 according to Embodiment 1 includes a case 10, a printing unit 20 (printing head), rollers 30, a movement distance measuring unit 40, a detector 50, an interface 60, and a controller 70.

The case 10 provides a space in which to arrange the components of the printer 1 such as the printing unit 20, the rollers 30, the movement distance measuring unit 40, the detector 50, the interface 60, and the controller 70. As illustrated in FIG. 1, the printing unit 20, the rollers 30, and the interface 60 are exposed from the case 10. Here, the case 10 is made of a resin or a metal but is not limited to being made of these materials.

The printing unit 20 is arranged on the bottom surface of the case 10 and prints the images to be printed onto the printing medium 2. The printing unit 20 includes an ink tank 21 that is filled with ink and a printing head 22 that dispenses droplets of the ink in the ink tank 21. The ink tank 21 supplies ink to the printing head 22. The printing head 22 includes a plurality of nozzles arranged in a primary scanning direction and in a secondary scanning direction. In the printing head 22, heaters inside of the nozzles apply heat to the ink to form vapor bubbles, and the formation of these vapor bubbles causes the ink to be propelled from the nozzles onto the printing medium 2. The printing unit 20 thus uses an inkjet technology to print images.

The rollers 30 are arranged on the bottom surface of the case 10 and rotate in contact with the printing medium 2 to allow the printer 1 to move smoothly. The rollers 30 include a front roller 31 arranged on the forward side of the printer 1 and a rear roller 32 arranged on the rear side. Moreover, there is a distance L between the point of contact of the forward roller 31 with the underlying object and the forwardmost portion of the printing head 22 of the printing unit 20.

The movement distance measuring unit 40 is a sensor that measures how far the printer 1 has moved. The movement distance measuring unit 40 includes a light-emitting diode (LED) 41 and an image sensor 42, and the image sensor 42 detects light that reflects off of the printing medium 2 when the LED 41 is illuminated. The movement distance measuring unit 40 then compares the reflected light from before and after movement to measure the movement distance and the movement direction of the printer 1. The movement distance measuring unit 40 then sends data that includes the measured movement distance and movement direction to the controller 70.

The detector 50 is a sensor for detecting when the printer 1 or the printing unit 20 reaches a boundary between the printing medium 2 and another object (that is, the edge the printing medium 2). The detector 50 includes an accelerometer 51 that measures the acceleration of the printer 1 in the vertical direction (that is, in the direction orthogonal to the printing medium 2). The detector 50 then sends data that includes the acceleration measured by the accelerometer 51 to the controller 70.

Figure 3A:
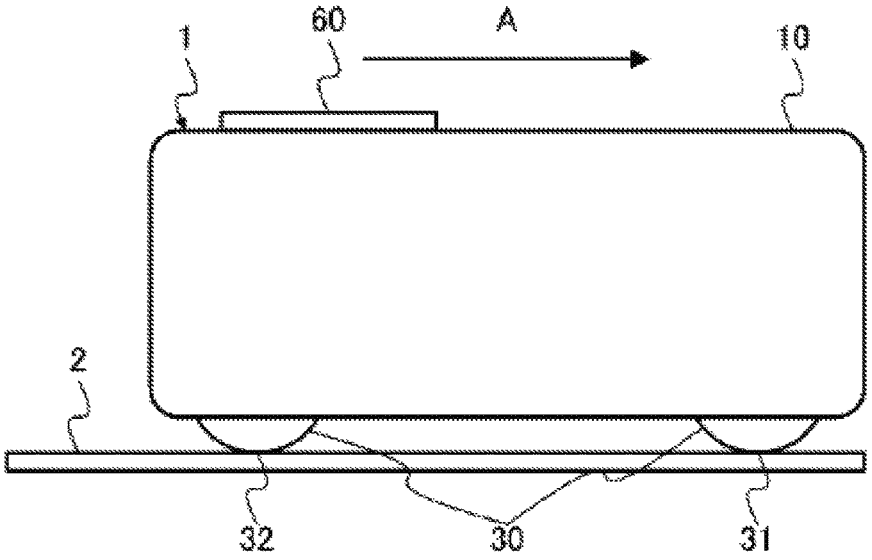
FIGS. 3A and 3B are side views of the printer according to Embodiment 1 on top of a printing medium and at the edge of the printing medium, respectively.
Figure 3B:
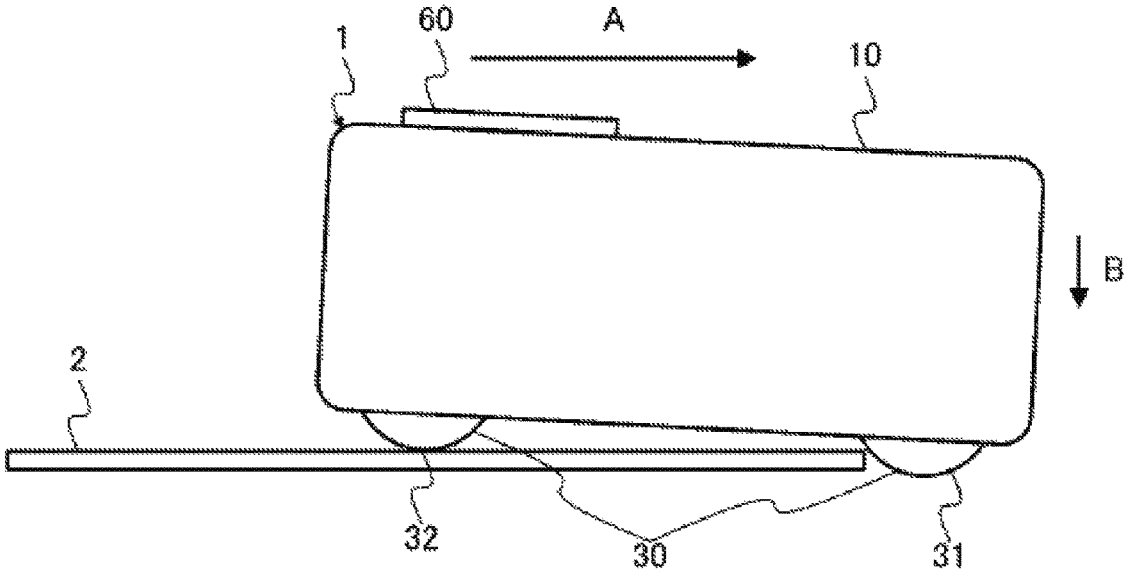

Next, a method of using the detector 50 to detect the edge of the printing medium 2 will be described in detail. FIGS. 3A and 3B are side views of the printer 1 while performing a printing process. Note that in FIGS. 3A and 3B, the components inside of the case 10 are not illustrated. As illustrated in FIG. 3A, the user moves the printer 1 in the direction indicated by the arrow A (the forward direction) in order to print an image. As illustrated in FIG. 3B, as the printer 1 and the printing unit 20 move, when the front roller 31 reaches the edge of the printing medium 2, the front roller 31 leaves the printing medium 2 and then moves in the direction indicated by the arrow B (the downward direction). At this time, the accelerometer 51 inside of the case 10 detects the downward acceleration of the printer 1 and sends data including that acceleration to the controller 70. The controller 70 then determines that the printer 1 or the printing unit 20 has reached the edge of the printing medium 2 on the basis of the downward acceleration detected by the detector 50. More specifically, the controller 70 determines that the front roller 31 has reached the edge of the printing medium 2.

The interface 60 accepts user input such as instructions to start printing or stop printing and also provides information to the user. The interface 60 sends any received instructions to start printing or stop printing to the controller 70 and provides any information received from the controller 70 to the user. The interface 60 may be buttons, keys, or a touch pad for accepting user input and a liquid crystal display or speakers for providing information to the user (or a touch panel that handles both), for example, but is not limited to these examples.

The controller 70 is a processor that executes a program to control the printer 1. The controller 70 may be a central processing unit (CPU), for example, but is not limited to this example.

When the interface 60 receives an instruction to start printing, the controller 70 obtains the printing start instruction information from the interface 60 and then controls the printing unit 20 in order to start printing. At this time, the user takes hold of the case 10 and begins to move the printer 1. The controller 70 then gets the movement distance measured by the movement distance measuring unit 40 and controls the printing unit 20 in order to print the image to be printed that corresponds to the current position of the printing unit 20 on the printing medium 2. Once a stop condition is satisfied, the controller 70 controls the printing unit 20 in order to stop printing. Here, the stop condition is satisfied once the entire image to be printed has been printed or once the interface 60 receives an instruction to stop printing.

Once printing has started, if the detector 50 detects a downward acceleration, the controller 70 gets the data including the acceleration detected by the detector 50 and determines that the printer 1 or the printing unit 20 has reached the boundary of the printing medium 2 and then controls the printing unit 20 in order to stop printing.

The storage unit 80 stores programs and data used when the controller 70 executes processes and functions as a working region for when the controller 70 is executing processes. The storage unit 80 can store a program for controlling the printing unit 20 in order to print, a program for controlling the movement distance measuring unit 40 in order to measure movement distances, a program for controlling the detector 50 in order to detect the edge of the printing medium 2, and data corresponding to the images to be printed, for example, but is not limited to storing these examples. The storage unit 80 may be a computer-readable storage medium such as a read-only memory (ROM) or a random-access memory (RAM), for example, but is not limited to these examples.

Figure 4:
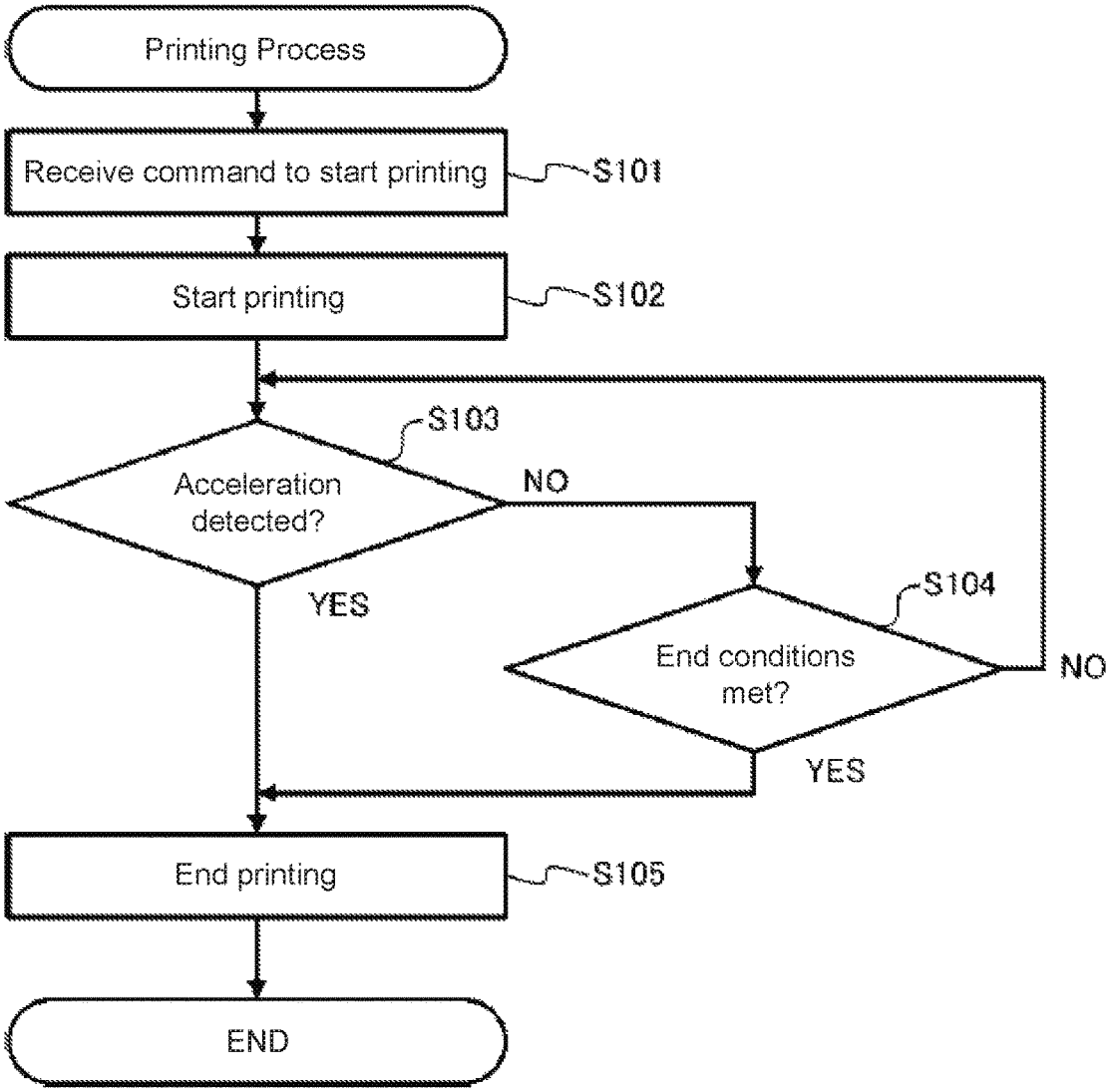
FIG. 4 is a flowchart of a printing process according to Embodiment 1.

FIG. 4 is a flowchart of a printing process according to Embodiment 1. Next, the printing process executed by the printer 1 according to Embodiment 1 will be described with reference to the flowchart in FIG. 4.

First, in step S101, the interface 60 receives an instruction to start printing from the user. Then, in step S102, the controller 70 gets the instruction to start printing from the interface 60 and controls the printing unit 20 in order to start printing.

Once printing has started, the controller 70 proceeds to step S103 and determines whether the detector 50 has detected any downward acceleration.

If it is determined that no downward acceleration has been detected (NO in step S103), the controller 70 proceeds to step S104 and determines whether a stop condition has been satisfied.

If it is determined that the stop condition has been satisfied (YES in step S104), the controller 70 proceeds to step S105 and controls the printing unit 20 in order to stop printing, thus ending the printing process. If it is determined that the stop condition has not been satisfied (NO in step S104), the controller 70 returns to step S103 and continues the printing process.

In step S103, if it is determined that the detector 50 has detected downward acceleration (YES in step S103), the controller 70 proceeds to step S105 and controls the printing unit 20 in order to stop printing, thus ending the printing process.

Configuring the printer 1 according to Embodiment 1 as described above and executing the printing process as described above makes it possible to prevent printing that is not expected by the user in regions outside of the printing region of a printing medium 2. In other words, upon entering a region (position) in which it is not appropriate for the printing unit 20 of the printer 1 to continue printing because the edge of the printing medium 2 has been reached, it is possible to prevent printing in that unsuitable region (position), thereby making it possible to efficiently print only in regions in which the printing medium 2 is present (that is, in regions that are suitable for printing). This not only prevents application of ink in regions outside of the printing region of the printing medium 2 but also makes it possible to prevent wasteful ink usage.

Embodiment 2

Next, a printer 1 according to Embodiment 2 will be described with reference to figures.

Here, once printing has started, if a detector 50 detects a downward acceleration, a controller 70 gets data including the acceleration detected by the detector 50 and determines that the printer 1 or a printing unit 20 has reached the boundary of a printing medium 2.

In Embodiment 1, upon determining that the printer 1 or the printing unit 20 has reached the boundary of the printing medium 2, the controller 70 controls the printing unit 20 in order to stop printing. However, in Embodiment 2, upon determining that the printer 1 or the printing unit 20 has reached the boundary of the printing medium 2, the controller 70 controls the printing unit 20 in order to continue printing for exactly a distance L before stopping the printing process.

Figure 5:
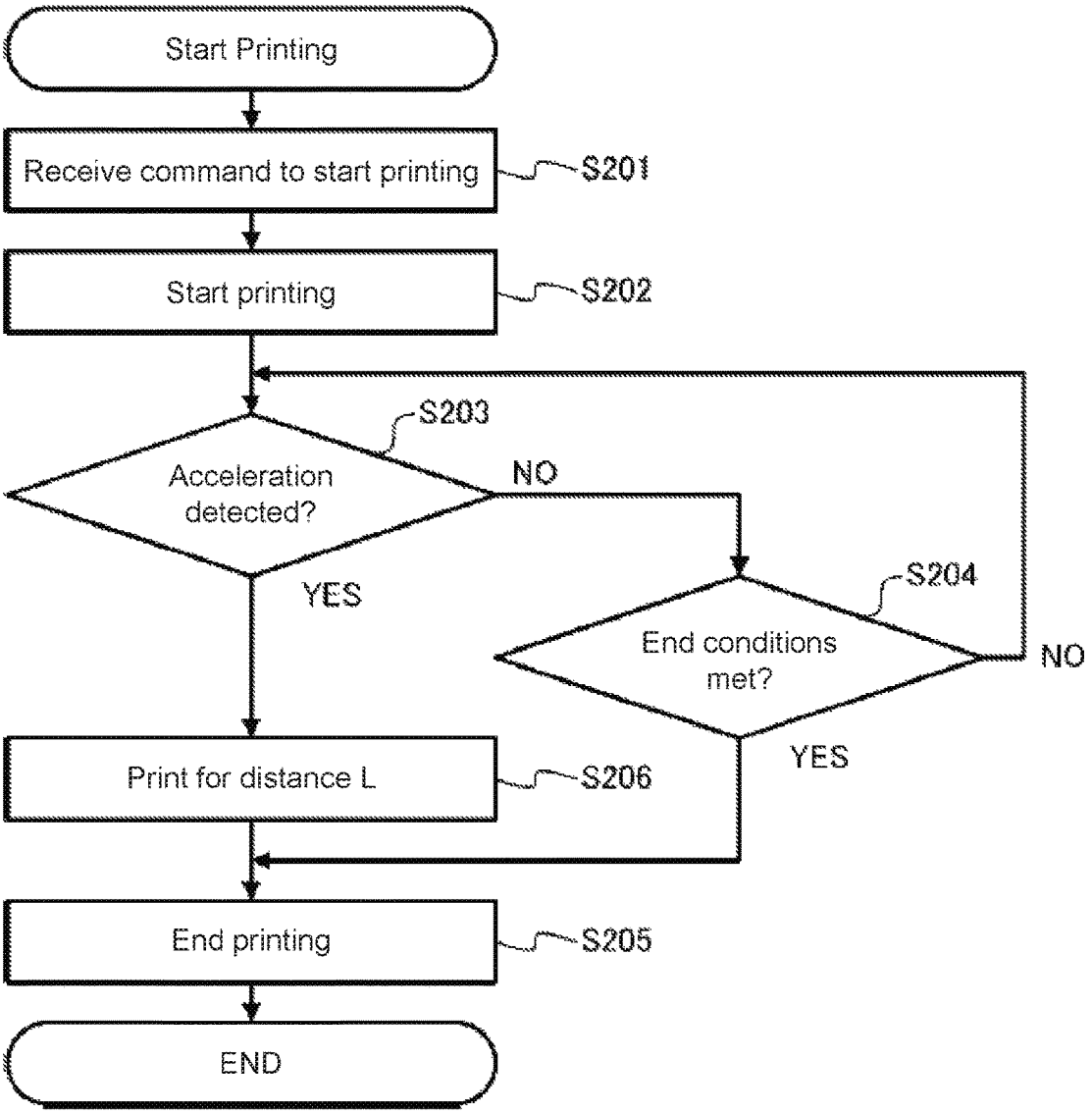
FIG. 5 is a flowchart of a printing process according to Embodiment 2.

FIG. 5 is a flowchart of a printing process according to Embodiment 2. Next, the printing process executed by the printer 2 according to Embodiment 1 will be described with reference to the flowchart in FIG. 5. Step S201 to step S205 are the same, respectively, as step S101 to step S105 in Embodiment 1.

In step S203, if it is determined that the detector 50 has detected downward acceleration (YES in step S203), the controller 70 proceeds to step S206 and controls the printing unit 20 in order to continue printing for a distance L and then proceeds to step S205.

Configuring the printer 1 according to Embodiment 2 as described above and executing the printing process as described above makes it possible to prevent printing that is not expected by the user in regions outside of the printing region of a printing medium 2. In other words, upon entering a region in which it is not appropriate for the printing unit 20 of the printer 1 to continue printing because the edge of the printing medium 2 has been reached, it is possible to prevent printing in that unsuitable region. This not only makes it possible to efficiently print only in regions in which the printing medium 2 is present (that is, in regions that are suitable for printing) but also makes it possible to print all the way to the edge of the printing medium 2 and thereby print efficiently without wasting the printing medium 2.

Embodiment 3

Next, a printer 1 according to Embodiment 3 will be described with reference to figures.

In Embodiment 3, a controller 70 uses a variable h that represents changes in the height of a printer 1. Upon starting the printing process, the controller 70 sets h to 0. The controller 70 then gets data that includes acceleration a from a detector 50. The controller 70 decrements h upon receiving data that includes downward acceleration (that is, data in which a<0) and increments h upon receiving data that includes upward acceleration (that is, data in which a<0).

After printing has started, the controller 70 only continues printing while h=0. When the value of h changes from h=0 to h≠0, the controller 70 stores, in a storage unit 80, information that represents a position P that is a distance L in front of the position at which the value of h changed. Moreover, when the value of h changes from h≠0 to h=0, the controller 70 stores, in the storage unit 80, information that represents a position Q that is a distance L in front of the position at which the value of h changed. The information that represents the position P and the position Q and is stored in the storage unit 80 is not limited to containing a single value for each position, and information that represents a plurality of positions P and positions Q may be stored in the storage unit 80.

Upon determining that the current position of the printer 1 is equal to the position P (that is, that the printer 1 or a printing unit 20 has reached the position P), the controller 70 controls the printing unit 20 in order to stop printing. Furthermore, upon determining that the current position of the printer 1 is equal to the position Q (that is, that the printer 1 or the printing unit 20 has reached the position Q), the controller 70 controls the printing unit 20 in order to resume printing.

Figure 6:
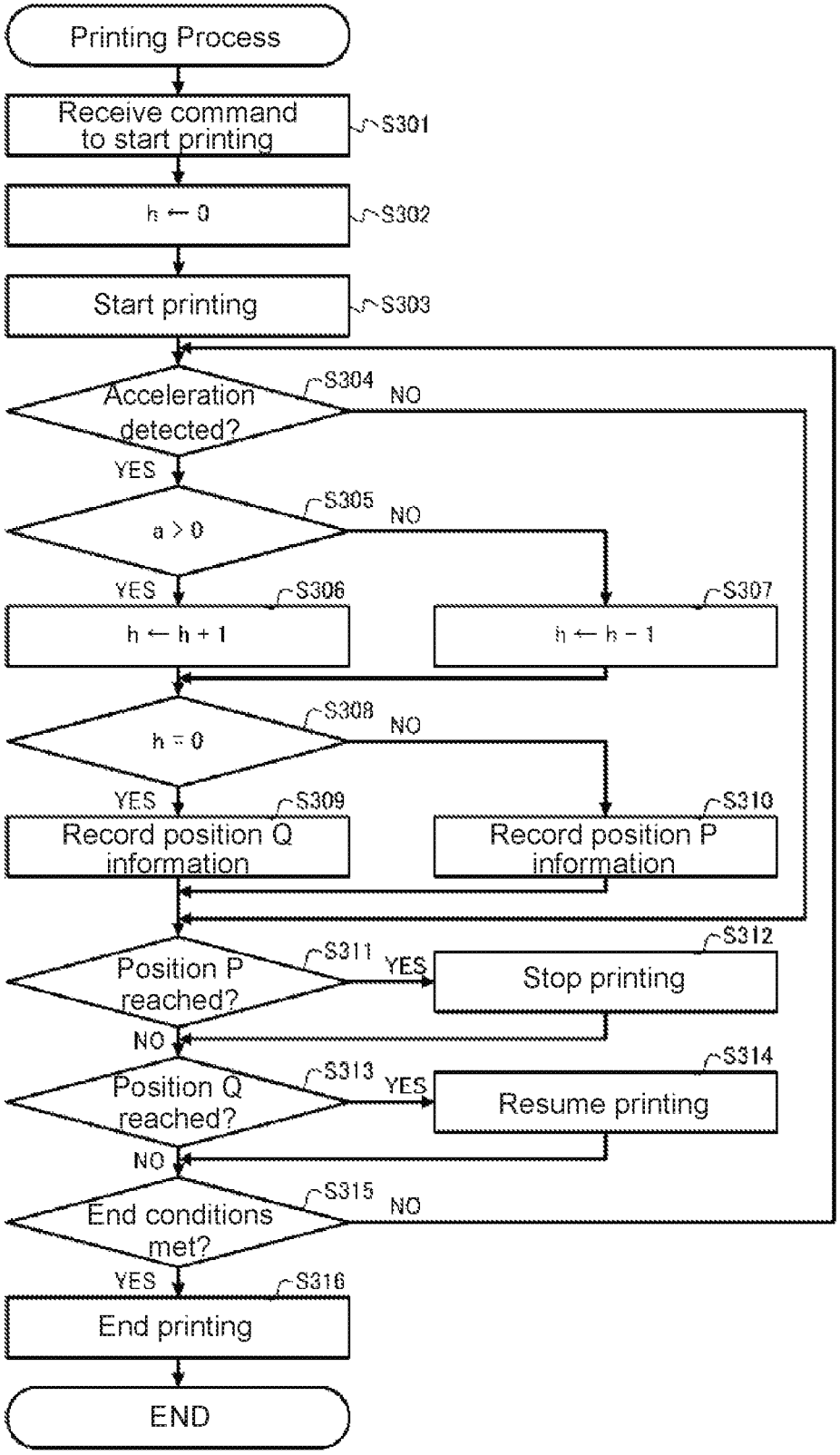
FIG. 6 is a flowchart of a printing process according to Embodiment 3.

FIG. 6 is a flowchart of a printing process according to Embodiment 3. Next, the printing process executed by the printer 3 according to Embodiment 1 will be described with reference to the flowchart in FIG. 6.

First, in step S301, an interface 60 receives an instruction to start printing from the user. In step S302, the controller 70 gets the instruction to start printing from the interface 60 and sets the variable h to 0, and then the controller 70 proceeds to step S303 and controls the printing unit 20 in order to start printing.

Once printing has started, the controller 70 proceeds to step S304 and determines whether the detector 50 has detected any acceleration.

If it is determined that no acceleration has been detected (NO in step S304), the controller 70 proceeds to step S311 (described below). If it is determined that acceleration has been detected (YES in step S304), the controller 70 proceeds to step S305, gets the acceleration a from the detector 50, and then determines whether a is greater than 0.

If a>0 (YES in step S305), the controller 70 proceeds to step S306 and increments the value of h. If a<0 (NO in step S305), the controller 70 proceeds to step S307 and decrements the value of h.

After incrementing or decrementing the value of h, the controller 70 proceeds to step S308 and determines whether h=0.

If h=0 (YES in step S308), the controller 70 proceeds to step S309 and stores, in the storage unit 80, information that represents a position Q that is in front of the current position by the distance L. If h≠0 (NO in step S308), the controller 70 proceeds to step S310 and stores, in the storage unit 80, information that represents a position P that is in front of the current position by the distance L.

After storing the information that represents the position P or the position Q in the storage unit 80, the controller 70 proceeds to step S311 and determines whether the printer 1 or the printing unit 20 has reached the position P.

If it is determined that the position P has been reached (YES in step 311), the controller 70 proceeds to step S312 and controls the printing unit 20 in order to stop printing, and then proceeds to step S313 (described next).

If it is determined that the position P has not been reached (NO in step 311), the controller 70 proceeds to step S313 and determines whether the printer 1 or the printing unit 20 has reached the position Q.

If it is determined that the position Q has been reached (YES in step 313), the controller 70 proceeds to step S314 and controls the printing unit 20 in order to resume printing, and then proceeds to step S315 (described next).

If it is determined that the position Q has not been reached (NO in step 313), the controller 70 proceeds to step S315 and determines whether a stop condition has been satisfied.

If it is determined that the stop condition has been satisfied (YES in step S315), the controller 70 proceeds to step S316 and controls the printing unit 20 in order to stop printing, thus ending the printing process. If it is determined that the stop condition has not been satisfied (NO in step S315), the controller 70 returns to step S304.

Configuring the printer 1 according to Embodiment 3 as described above and executing the printing process as described above makes it possible to prevent printing that is not expected by the user in regions outside of the printing region of a printing medium 2. Furthermore, this makes it possible to detect the edge of the printing medium 2 and resume printing when the edge of the printing medium 2 is reached again. In this way, upon entering a region in which it is not appropriate for the printing unit 20 of the printer 1 to continue printing because the printing medium 2 is not present in a certain region due to the presence of a hole or because there are irregularities in the surface of the printing medium 2, for example, it is possible to prevent printing in that unsuitable region. This makes it possible to efficiently print only in regions in which the printing medium 2 is present or in which there are no irregularities in the surface of the printing medium 2 (that is, in regions that are suitable for printing). More specifically, this makes it possible to stop printing before reaching regions in which the printing medium 2 is not present or regions in which there are irregularities in the surface of the printing medium 2 and then resume printing after passing those regions.

Embodiment 4

Next, a printer 1 according to Embodiment 4 will be described with reference to figures.

Figure 7A:
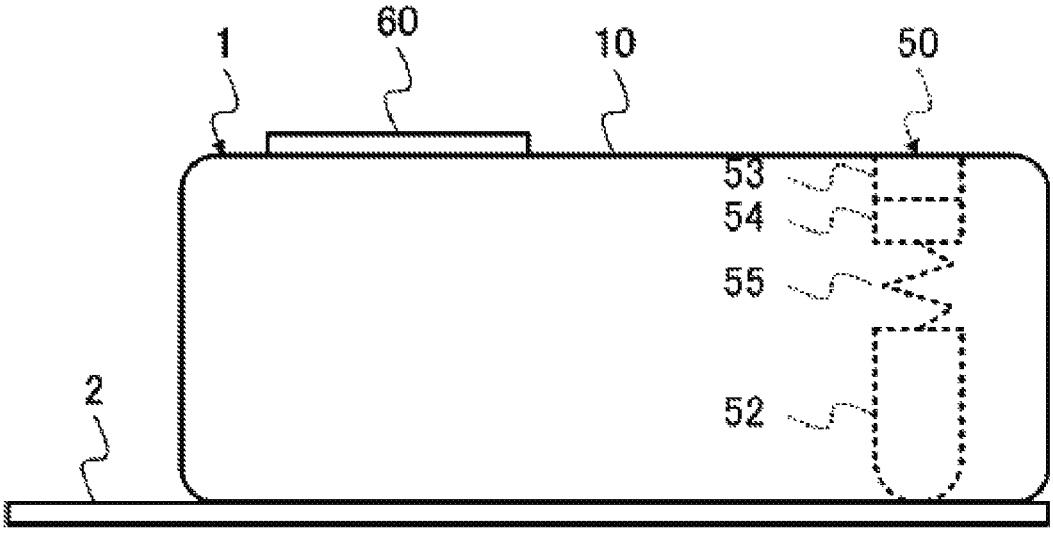
FIG. 7A is a side view of a printer according to Embodiment 4 on top of a printing medium.
Figure 7B:
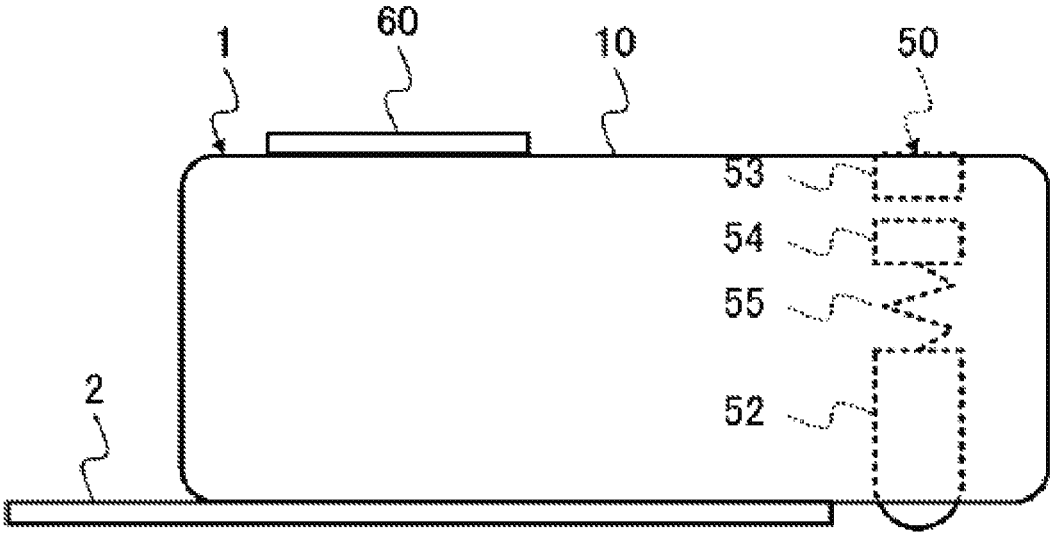
FIG. 7B is a side view of the printer according to Embodiment 4 at the edge of the printing medium.

FIGS. 7A and 7B are side views of the printer 1 according to Embodiment 4. Note that in FIGS. 7A and 7B, the components inside of a case 10 other than a detector 50 are not illustrated.

As illustrated in FIG. 7A, the printer 1 according to Embodiment 4 does not include the rollers 30 of Embodiment 1, and instead the bottom surface of the case 10 contacts a printing medium 2. In Embodiment 4, the detector 50 includes a contact member 52, a contact sensor 53, a conductor board 54, and a spring 55.

The contact member 52 is formed having a rod shape and is arranged so as to be able to move within the case 10 and such that one end can protrude out from the bottom surface of the case 10. As illustrated in the figures, when the printer 1 or a printing unit 20 reaches the edge of the printing medium 2, the contact member 52 protrudes out from the bottom surface of the case 10.

The contact sensor 53 includes a plurality of conducting points formed on the surface thereof and detects when contact is made on the basis of the current that flows when a conductive material contacts the conducting points on the surface. The contact sensor 53 is arranged at a position above the contact member 52 inside of the case 10. The contact sensor 53 detects when contact is made with a conductor board 54.

The conductor board 54 is connected to the other end of the contact member 52 by the spring 55. As illustrated in FIG. 7A, when the printer 1 is positioned on top of the printing medium 2, the contact member 52 does not protrude out from the bottom surface of the case 10, and the conductor board 54 contacts the contact sensor 53. As illustrated in FIG. 7B, when the printer 1 or the printing unit 20 reaches the edge of the printing medium 2, the contact member 52 protrudes out from the bottom surface of the case 10 and the conductor board 54 moves away from the contact sensor 53, which causes the contact sensor 53 to detect that the conductor board 54 has separated. This separation of the conductor board 54 from the contact sensor 53 means that the contact member 52 has protruded out from the bottom surface of the case 10, which means that the printer 1 or the printing unit 20 has reached the boundary of the printing medium 2.

Once the contact sensor 53 detects that the conductor board 54 has separated, the detector 50 sends the detected data to a controller 70. Upon getting this data from the detector 50, the controller 70 determines that the printer 1 or the printing unit 20 has reached the boundary of the printing medium 2 and then controls the printing unit 20 in order to stop printing.

Configuring the printer 1 according to Embodiment 4 as described above makes it possible to prevent printing that is not expected by the user in regions outside of the printing region of the printing medium 2. In other words, upon entering a region in which it is not appropriate for the printing unit 20 of the printer 1 to continue printing because the edge of the printing medium 2 has been reached, it is possible to prevent printing in that unsuitable region. This not only makes it possible to efficiently print only in regions in which the printing medium 2 is present (that is, in regions that are suitable for printing) but also makes it possible to remove the rollers 30 and make the bottom surface of the case 10 flat.

Embodiment 5

Next, a printer 1 according to Embodiment 5 will be described with reference to figures.

Figure 8:
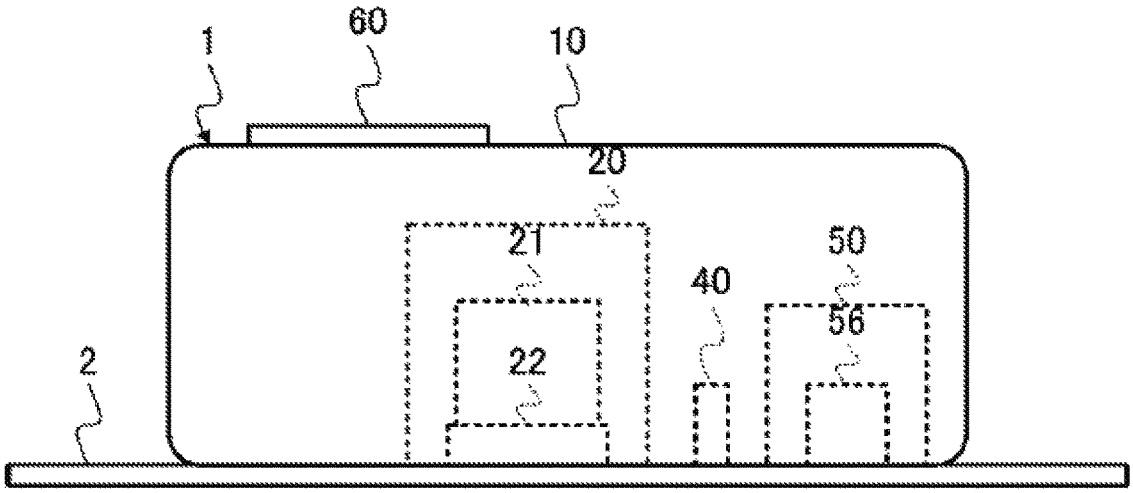
FIG. 8 is a side view of a printer according to Embodiment 5.

FIG. 8 is a side view of the printer 1 according to Embodiment 5. As illustrated in FIG. 8, the printer 1 according to Embodiment 5 does not include the rollers 30 of Embodiment 1, and instead the bottom surface of a case 10 contacts a printing medium 2. As illustrated in FIG. 8, a detector 50 of Embodiment 5 includes a surface sensor 56.

The surface sensor 56 measures SQUAL (Surface QUALity) values that represent the state of the surface of a printing medium 2. The surface sensor 56 is arranged exposed from the bottom surface of the case 10. A detector 50 sends data that includes the SQUAL values measured by the surface sensor 56 to a controller 70.

The controller 70 gets the data that includes the SQUAL values from the detector 50 and calculates an average value m1 of times ΔT in the SQUAL values for the printing medium 2. The controller 70 then compares a SQUAL value s obtained from the detector 50 to the average value m1, and if the absolute value of that difference is greater than a threshold value, the controller 70 determines that the printer 1 or a printing unit 20 has reached the boundary of the printing medium 2 and then controls the printing unit 20 in order to stop printing.

Once printing has been stopped, the controller 70 calculates an average value m2 of the times ΔT in the SQUAL values. The controller 70 then compares the average value m1 to the average value m2, and if the absolute value of the difference is less than a threshold value, the controller 70 determines that the printer 1 or the printing unit 20 has reached the boundary of the printing medium 2 again and that the printing unit 20 is back on top of the printing medium 2 and therefore controls the printing unit 20 in order to resume printing. If the absolute value of the difference is greater than the threshold value, the controller 70 determines that the printer 1 is not yet back on top of the printing medium 2 and therefore stops printing.

Figure 9:
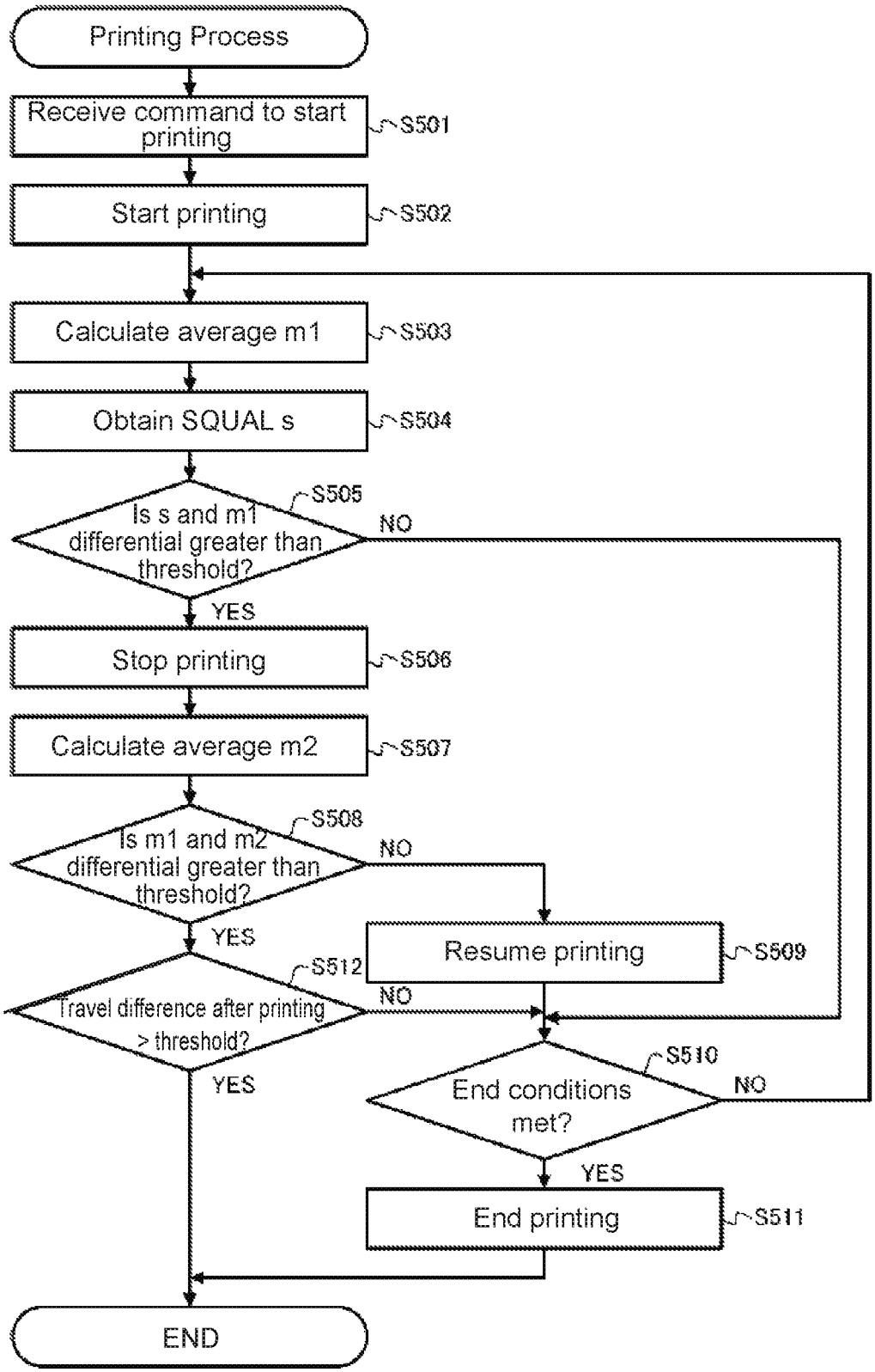
FIG. 9 is a flowchart of a printing process according to Embodiment 5.

FIG. 9 is a flowchart of a printing process according to Embodiment 5. Next, the printing process executed by the printer 5 according to Embodiment 1 will be described with reference to the flowchart in FIG. 9. Note that step S501 and step S502 are the same, respectively, as step S101 and step S102 in Embodiment 1.

After starting printing in step S502, the controller 70 proceeds to step S503 and gets the data that includes the SQUAL values from the detector 50 and then calculates the average value m1 of the times ΔT in the SQUAL values for the printing medium 2.

After calculating the average value m1, the controller 70 proceeds to step S504 and gets a SQUAL value s from the detector 50.

After getting the SQUAL value s, the controller 70 proceeds to step S505 and compares s and m1 in order to determine whether the absolute value of the difference between s and m1 is greater than a threshold value. If it is determined that the absolute value is greater than the threshold value (YES in step S505), the controller 70 proceeds to step S506 and controls the printing unit 20 in order to stop printing.

After stopping printing, the controller 70 proceeds to step S507 and gets the data that includes the SQUAL values from the detector 50 and then calculates the average value m2 of the times ΔT in the SQUAL values.

After calculating the average value m2, the controller 70 proceeds to step S508 and compares m1 and m2 in order to determine whether the absolute value of the difference between m1 and m2 is greater than a threshold value.

If it is determined that the absolute value is greater than the threshold value (YES in step S508), the controller 70 proceeds to step S512 (described below). If it is determined that the absolute value is less than or equal to the threshold value (NO in step S508), the controller 70 proceeds to step S509 and controls the printing unit 20 in order to resume printing.

After resuming printing, the controller 70 proceeds to step S510 and determines whether a stop condition has been satisfied.

If it is determined that the stop condition has been satisfied (YES in step S510), the controller 70 proceeds to step S511 and controls the printing unit 20 in order to stop printing, thus ending the printing process. If it is determined that the stop condition has not been satisfied (NO in step S510), the controller 70 returns to step S503.

In step S505, if it is determined that the absolute value of the difference between s and m1 is less than or equal to the threshold value (NO in step S505), the controller 70 proceeds to step S510.

In step S512, the controller 70 determines whether the distance that the printer 1 has traveled since printing was stopped in step S506 is greater than a threshold value. If it is determined that the travel distance is greater than the threshold value (YES in step S512), the controller 70 ends the printing process. If it is determined that the travel distance is not greater than the threshold value (NO in step S512), the controller 70 proceeds to step S510.

Configuring the printer 1 according to Embodiment 5 as described above and executing the printing process as described above makes it possible to prevent printing that is not expected by the user in regions outside of the printing region of a printing medium 2. In other words, upon entering a region in which it is not appropriate for the printing unit 20 of the printer 1 to continue printing because the edge of the printing medium 2 has been reached, it is possible to prevent printing in that unsuitable region. This not only makes it possible to efficiently print only in regions in which the printing medium 2 is present (that is, in regions that are suitable for printing) but also makes it possible to remove the rollers 30 and make the bottom surface of the case 10 flat. Furthermore, this also makes it possible to prevent printing in regions that are not suitable for printing even when the edge of the printing medium 2 has not been reached if a significant change in the surface state is detected.

Modification Examples

Although several embodiments of the present invention were described above, these embodiments are only examples, and the scope of the present invention is not limited to these examples. In other words, embodiments of the present invention may take a wide variety of forms, and all such embodiments are included in the scope of the present invention.

For example, in the embodiments described above, the printing unit 20 includes the ink tank 21 and the printing head 22 and prints using an inkjet technology, but the present invention is not limited to this example. The printing unit may print using any printing technology, including thermal printing or thermal transfer printing.

In the embodiments described above, the movement distance measuring unit 40 includes the LED 41 and the image sensor 42 and measures movement distances by using the image sensor 42 to detect light that reflects off of the printing medium 2 when the LED 41 is illuminated. However, the present invention is not limited to this example. The movement distance of the printer 1 may instead be measured by illuminating the rollers 30 with light and then measuring the light that is reflected in order to measure the rotation speed of the rollers 30. Alternatively, these two methods may be used in conjunction.

In the embodiments described above, after printing starts, the controller 70 controls the printing unit 20 in order to stop printing when the detector 50 detects a downward acceleration. However, the present invention is not limited to this example. The controller 70 may instead stop printing only if the acceleration detected by the detector 50 is greater than a threshold value and otherwise continue printing if the acceleration is not greater than the threshold value. This prevents printing from being stopped if small foreign objects or dents in the printing medium 2 are encountered.

In the embodiments described above, the controller 70 controls the printing unit 20 in order to stop printing upon determining that a stop condition has been satisfied, but the present invention is not limited to this example. If the stop condition is satisfied while the printing unit 20 is not printing, the printing process may simply be ended as-is.

In Embodiment 2, the controller 70 controls the printing unit 20 in order to stop printing once printing has continued for a distance L, but the present invention is not limited to this example. Printing may also be stopped after printing has continued for any distance less than the distance L. This makes it possible to leave blank space on the printing medium 2. Furthermore, the controller 70 may compare a length of a portion of the image to be printed that has not yet been printed to the distance L and then stop printing if the length of the portion that has not yet been printed is greater than the distance L, or continue printing if the length of the portion that has not yet been printed is less than or equal to the distance L in order to complete that portion and then end the printing process.

In Embodiment 3, if no acceleration is detected for a prescribed period of time after printing has been stopped, the printing process may be ended. This makes it possible to end the printing process if the edge of the printing medium 2 is not reached after a prescribed period of time. Moreover, the printing process may be ended if no acceleration is detected as the printer 1 moves a prescribed distance.

Figure 10:
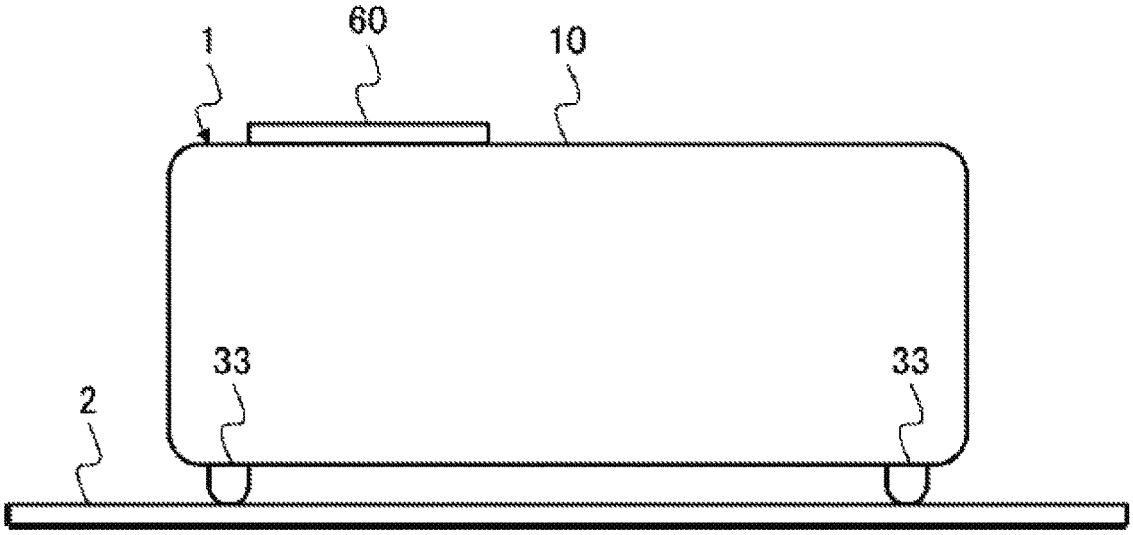
FIG. 10 is a side view of a printer according to a modification example.

The printer 1 according Embodiments 1 to 3 included the rollers 30, but the present invention is not limited to these examples. The rollers 30 may be removed, and the printer 1 may be moved over the printing medium 2 directly. In this case, it is preferable that protrusions 33 be formed on the bottom surface of the case 10 at a position further forward than the printing unit 20. FIG. 10 is a side view of a printer 1 that includes such protrusions 33. As illustrated in FIG. 10, including the protrusions 33 facilitates detection of downward acceleration at the edge of the printing medium 2.

The printer 1 according Embodiments 4 and 5 did not include the rollers 30, but the present invention is not limited to these examples. The printer 1 may include the rollers 30 or the protrusions 33.

In Embodiment 5, the surface sensor 56 is a sensor that measures the SQUAL values that represent the state of the surface of the printing medium 2, but the present invention is not limited to this example. The surface sensor 56 may instead be a sensor that measures the reflectance of the printing medium 2. In this case, the controller 70 gets reflectance values measured by the detector 50 and then calculates and compares the average values.

In Embodiment 1, the detector 50 detects downward acceleration, but the present invention is not limited to this example. The detector 50 may also detect upward acceleration, in which case it may be determined that an obstacle is present and that printing should be stopped accordingly.

The printer 1 may include any combination of the components of Embodiments 1 to 5. For example, the detector 50 of the printer 1 may include the accelerometer 51 of Embodiment 1; the contact member 52, the contact sensor 53, the conductor board 54, and the spring 55 of Embodiment 4; and the surface sensor 56 of Embodiment 5. Alternatively, the printer 1 may include any combination of the components of Embodiments 1 to 5.

Furthermore, the present invention may be provided in the form of a printer that already includes all of the components required to achieve the features of the present invention, or an existing information processing device or the like may use programs in order to function as the printer according to the present invention. In other words, programs for implementing the features of the printers described in Embodiments 1 to 5 may be executed by a CPU or the like for controlling an existing information processing device or the like in order to make it possible for that information processing device to function as the printer according to the present invention. Moreover, the method of printing according to the present invention may be implemented using such a printer.

In addition, such programs may be implemented and used in any manner. For example, the programs may be stored on and used from a computer-readable storage medium such as a floppy disk, a Compact Disc Read-Only Memory (CD-ROM), a Digital Versatile Disc Read-Only Memory (DVD-ROM), or a memory card. Furthermore, the programs may be superimposed onto a carrier wave and then used via a communication medium such as the internet. For example, the programs may be posted on and distributed via a bulletin board system (BBS) on a communication network. Furthermore, the programs may be launched and executed similar to other applications and programs by an operating system (OS) in order to provide a configuration that can execute the processes described above.

Preferred embodiments of the present invention were described above. However, the present invention is not limited to the embodiments described above and includes all inventions included in the scope of the claims as well as their equivalents.

The present invention was described using the specific embodiment above as an example. However, the technical scope of the present invention is not limited to the embodiment described above. The scope of the present invention is not limited to the embodiment described above, and any configurations included in the scope of the claims and their equivalents are also encompassed by the present invention.

It is understood to persons skilled in the art that various modifications or improvements can be made to the specific embodiments described above, and such modifications and improvements are included within the technical scope of the present invention as defined by the claims.

What is claimed is:

1. A printer for printing on a printing medium as the printer moves, comprising:

a printing head printing an image on the printing medium when a user holds and moves the printer on the printing medium;

a detector arranged further forward in a movement direction of the printer than the printing head and detecting a boundary of the printing medium or a location on the printing medium not suitable to be printed on by the printing head while the printing head is printing the image on the printing medium due to the user holding and moving the printer on the printing medium; and a controller causing the printing head to stop printing before the printing head reaches the boundary of the printing medium or said location on the printing medium not suitable to be printed on, when the detector detects said boundary of the printing medium or said location on the printing medium not suitable to be printed on while the printing head is printing, wherein after the detector has detected the boundary of the printing medium or said location on the printing medium not suitable to be printed on, the controller allows the printing head to continue printing for a distance less than or equal to a distance between a location of a sensor of the detector and a location of a printing head of the printing head, and then the controller causes the printing head to stop printing, and wherein after the controller causes the printing head to stop printing, if the detector detects another boundary of the printing medium or a location on the printing medium that is suitable to be printed on by the printing head, the controller causes the printing head to resume printing from the another boundary of the printing medium or from said location that is suitable to be printed on by the printing head as detected by the detector.

2. The printer according to claim 1, wherein the detector includes an accelerometer that measures an acceleration occurring when the printer or the printing head reaches the boundary of the printing medium or said location on the printing medium not suitable to be printed on, and wherein, when the detector detects the acceleration while the printing head is printing, the controller causes the printing head to stop printing.

3. The printer according to claim 1, wherein the detector includes a contact sensor that conducts current when the printer of the printing head reaches the boundary of the printing medium or said location on the printing medium not suitable to be printed on, and wherein when conduction of current by the contact sensor is detected while the printing head is printing, the controller causes the printing head to stop printing.

4. The printer according to claim 1, wherein the detector includes a surface sensor that measures a value representing a surface state of the printing medium, and wherein the controller causes the printing head to stop printing when, on the basis of the value measured by the surface sensor, the controller determines that the printing head has reached the boundary of the printing medium or said location on the printing medium not suitable to be printed on.

5. A method of printing on a printing medium by moving a printer over the printing medium, comprising:

printing, using a printing head of the printer, an image on the printing medium when a user holds and moves the printer on the printing medium;

detecting, using a detector in the printer that is arranged further forward in a movement direction of the printer than the printing head, a boundary of the printing medium or a location on the printing medium not suitable to be printed on by the printing head while the printing head is printing the image on the printing medium due to the user holding and moving the printer on the printing medium; and causing the printing head to stop printing before the printing head reaches the boundary of the printing medium or said location on the printing medium not suitable to be printed on, when the detector detects said boundary of the printing medium or said location on the printing medium not suitable to be printed on while the printing head is printing, wherein after the detector has detected the boundary of the printing medium or said location on the printing medium not suitable to be printed on, the printing head is allowed to continue printing for a distance less than or equal to a distance between a location of a sensor of the detector and a location of a printing head of the printing head, and then the printing head is caused to stop printing, and wherein after the printing head is caused to stop printing, if the detector detects another boundary of the printing medium or a location on the printing medium that is suitable to be printed on by the printing head, the printing head is caused to resume printing from the another boundary of the printing medium or from said location that is suitable to be printed on by the printing head as detected by the detector.

6. The method of printing according to claim 5, wherein the detector includes an accelerometer that measures an acceleration occurring when the printer or the printing head reaches the boundary of the printing medium or said location on the printing medium not suitable to be printed on, and wherein, when the detector detects the acceleration while the printing head is printing, the printing head is caused to stop printing.

7. The method of printing according to claim 5, wherein the detector includes a contact sensor that conducts current when the printer of the printing head reaches the boundary of the printing medium or said location on the printing medium not suitable to be printed on, and wherein when conduction of current by the contact sensor is detected while the printing head is printing, the printing head is caused to stop printing.

8. The method of printing according to claim 5, wherein the detector includes a surface sensor that measures a value representing a surface state of the printing medium, and wherein the printing head is caused to stop printing when, on the basis of the value measured by the surface sensor, it is determined that the printing head has reached the boundary of the printing medium or said location on the printing medium not suitable to be printed on.

9. A non-transitory storage medium that stores instructions executable by a processor in a printer for printing on a printing medium as the printer moves, the instructions causing the processor to perform the following:

printing, using a printing head of the printer, an image on the printing medium when a user holds and moves the printer on the printing medium;

detecting, using a detector of the printer arranged further forward in a movement direction of the printer than the printing head, a boundary of the printing medium or a location on the printing medium not suitable to be printed on by the printing head while the printing head is printing the image on the printing medium due to the user holding and moving the printer on the printing medium; and causing the printing head to stop printing before the printing head reaches the boundary of the printing medium or said location on the printing medium not suitable to be printed on, when the detector detects said location on the printing medium not suitable to be printed on while the printing head is printing, wherein after the detector has detected the boundary of the printing medium or said location on the printing medium not suitable to be printed on, the printing head is allowed to continue printing for a distance less than or equal to a distance between a location of a sensor of the detector and a location of a printing head of the printing head, and then the printing head is caused to stop printing, and wherein after the printing head is caused to stop printing, if the detector detects another boundary of the printing medium or a location on the printing medium that is suitable to be printed on by the printing head, the printing head is caused to resume printing from the boundary of the printing medium or from said location that is suitable to be printed on by the printing head as detected by the detector.

10. The computer-readable storage medium according to claim 9, wherein the detector includes an accelerometer that measures an acceleration occurring when the printer or the printing head reaches the boundary of the printing medium or said location on the printing medium not suitable to be printed on, and wherein, when the detector detects the acceleration while the printing head is printing, the printing head is caused to stop printing.

11. The computer-readable storage medium according to claim 9, wherein the detector includes a contact sensor that conducts current when the printer of the printing head reaches the boundary of the printing medium or said location on the printing medium not suitable to be printed on, and wherein when conduction of current by the contact sensor is detected while the printing head is printing, the printing head is caused to stop printing.

12. The computer-readable storage medium according to claim 9, wherein the detector includes a surface sensor that measures a value representing a surface state of the printing medium, and wherein the printing head is caused to stop printing when, on the basis of the value measured by the surface sensor, it is determined that the printing head has reached the boundary of the printing medium or said location on the printing medium not suitable to be printed on.

* * * * *